United States Patent [19]

Wenkman et al.

[11] Patent Number: 4,718,573

[45] Date of Patent: Jan. 12, 1988

[54] DISPENSER FOR ELONGATED ARTICLES

[75] Inventors: Gregory J. Wenkman, Middleton; Ferdinand F. Salzmann, Prairie du Sac, both of Wis.

[73] Assignee: Traex Corporation, Dane, Wis.

[21] Appl. No.: 752,771

[22] Filed: Jul. 8, 1985

Related U.S. Application Data

[63] Continuation-in-part of Ser. No. 698,134, Feb. 4, 1985, abandoned.

[51] Int. Cl.[4] ..... B65H 3/62

[52] U.S. Cl. ..... 221/202; 221/205; 221/257

[58] Field of Search ..... 221/255, 256, 257, 202, 221/204, 205, 179, 281, 282

[56] References Cited

U.S. PATENT DOCUMENTS

| | | | |
|---|---|---|---|
| 748,065 | 12/1903 | Green | 221/281 X |
| 868,989 | 10/1907 | Kent | 221/197 X |
| 1,512,464 | 10/1924 | Hekrdle | 221/281 X |
| 2,096,652 | 10/1937 | Schoff | 221/197 X |
| 2,788,154 | 4/1957 | Allen | 221/281 X |
| 4,219,130 | 8/1980 | Wenkman et al. | 221/202 |
| 4,402,425 | 9/1983 | von Schuckmann | 221/202 |
| 4,466,229 | 8/1984 | Gino | 221/205 X |

*Primary Examiner*—Robert J. Spar
*Assistant Examiner*—Jay I. Alexander
*Attorney, Agent, or Firm*—Isaksen, Lathrop, Esch, Hart & Clark

[57] ABSTRACT

A dispenser for elongated articles that is especially adapted for convenient assembly. The dispenser has a generally rectangular storage bin having an inner chamber and an article discharge slot that extends substantially from side to side across the front of the chamber. A chamber floor inclines downwardly toward the article discharge slot, and a lever arm is hingedly attached to the chamber floor to form therewith a lever arm-floor assemblage that includes substantially all of those moving parts the dispenser whose function directly relates to dispensing articles therefrom. The lever arm extends forwardly through the article discharge slot and has a depressed dispensing position and an elevated closed position. Means are provided for attaching the floor portion of a preassembled lever arm-floor assemblage within the chamber in secure, rigidly attached relation, whereby substantially all of the moving parts of the dispenser that are related to dispensing may be assembled with convenience at a location outside the chamber and then be installed within the chamber. Front wall attachments which maximize dispensing reliability are also disclosed.

15 Claims, 7 Drawing Figures

DISPENSER FOR ELONGATED ARTICLES

This is a continuation-in-part of our prior application Ser. No. 698,134 filed Feb. 4, 1985, now abandoned.

TECHNICAL FIELD

The present invention relates to dispensers in general and in particular to manually operated devices for dispensing elongated articles from a reservoir of such articles.

BACKGROUND OF ART

Receptacles for dispensing elongated articles are generally known in which a tab or arm is depressed by a user so as to dispense a single elongated article such as a drinking straw. Dispensers are also known in which a pivotally mounted member carries a single article from inside the dispenser to the outside. An example of such a dispenser is shown in U.S. Pat. No. 4,219,130, which patent is assigned to the assignee of the present invention. An example of a similar dispenser is shown in U.S. Pat. No. 1,008,867, and other examples of apparatus for dispensing such elongated articles are shown in U.S. Pat. Nos. 592,105, 1,229,982, 1,676,109, 1,678,355, 1,773,329, 2,310,933, and 3,412,896. A manufacturing and assembly difficulty that is often encountered with such dispensers is that they tend to employ moving parts located within an overall bin or container. When the articles to be dispensed are relatively small, such as conventional drinking straws, assembly can be cramped, difficult, and time-consuming. Similarly, repair of broken dispensers may be hampered by inaccessibility of the moving parts. Generally it is necessary that such dispensers be of relatively low cost in order to be able to compete with the use of open bins and comparable alternative ways of presenting drinking straws and the like to users. Consequently, efficient and easy manufacture and repair is of heightened importance.

SUMMARY OF THE INVENTION

The present invention is summarized in that it a dispenser for elongated articles that is especially adapted for convenient assembly includes a storage bin. The storage bin has a front wall and a rear wall opposed thereto and further includes opposed side walls. The uppermost margins of the front, rear, and side walls define a top opening. Inner surfaces of those walls define a chamber. The front wall has an article discharge slot extending substantially from side wall to side wall and having a size sufficient to allow any elongated article to be dispensed therethrough with its longitudinal axis oriented generally horizontally and parallel to the front wall. A chamber floor is contained within the chamber and inclines downwardly toward the article discharge slot. A lever arm is hingedly attached to the chamber floor to form therewith a lever arm-floor assemblage having a lever arm portion and a floor portion. The lever arm-floor assemblage includes substantially all of those moving parts of the dispenser whose function directly relates to dispensing elongated articles therefrom. The lever arm extends forwardly through the article discharge slot and has a dispensing position, in which its forwardmost parts are depressed, and a closed position, in which its forwardmost parts are elevated. Retaining means are included for retaining the elongated articles within the chamber when the lever is in its closed position and dispensing a selected number of elongated articles through the article discharge slot when the lever arm is in its dispensing position. Means are included for attaching the floor portion of a preassembled lever arm-floor assemblage within the chamber in secure, rigidly attached relation, whereby substantially all of the moving parts of the dispenser that are related to dispensing may be assembled with convenience at a location outside the chamber and then be installed within the chamber. Front wall attachments which maximize the dispensing reliability are also disclosed.

It is an object of the present invention to construct a dispenser for elongated articles that can be quickly and easily assembled from a minimum of fitted parts.

It is another object of the present invention to construct such a dispenser in which the possibility of the objects jamming within the unit is reduced.

It is yet another object of the present invention to provide such a dispenser that is both efficient in its operation and economical to manufacture.

Other objects, advantages, and features of the present invention will be apparent from the following specification, when taken in conjunction with the accompanying drawings.

DETAILED DESCRIPTION OF THE PREFERRED EMBODIMENT

Figure 1:
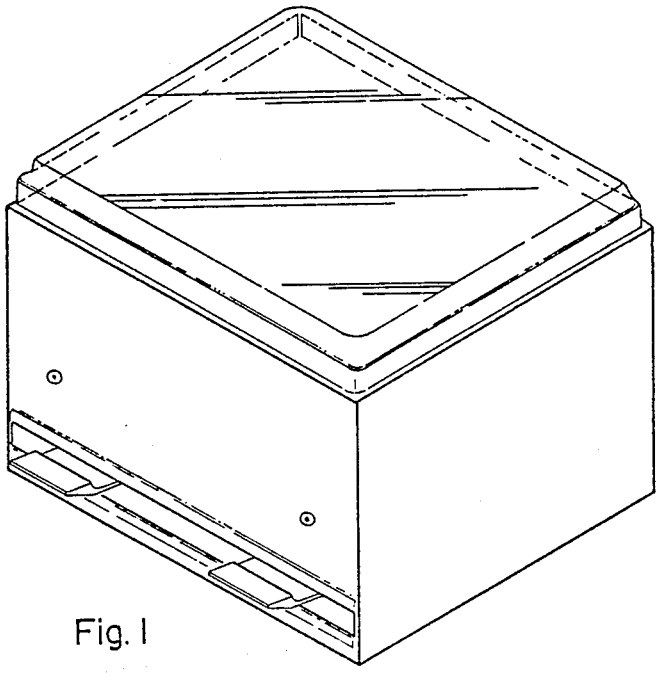
FIG. 1 is a perspective view of a dispenser constructed in accord with the present invention.
Figure 2:
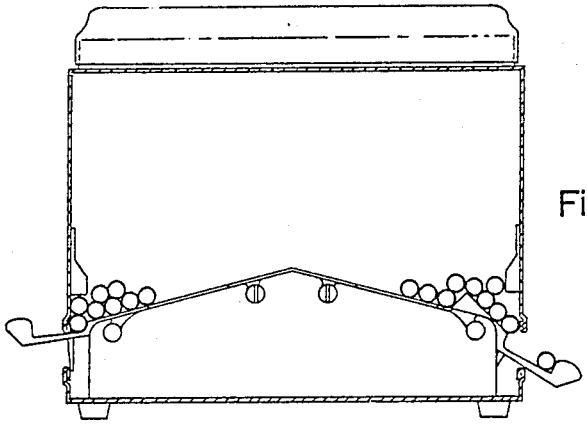
FIG. 2 is a cross sectional view taken along section line 2—2 of FIG. 1 just inside the storage bin wall but outside of the side support brackets.

Referring more particularly to the drawings, wherein like numbers refer to like parts, FIG. 1 shows a dispenser for elongated articles, generally indicated at 10, constructed in accord with the present invention. The dispenser 10 of the invention is intended for use with elongated articles capable of rolling or sliding freely in a direction generally at right angles to their longitudinal axis. For purposes of illustration and easy description, conventional drinking straws shall be used as an example typical of such elongated articles in the description below. However, the invention in no way is limited to use with drinking straws, in that pencils, toothpicks, lengths of pipe, and other comparable elongated articles can likewise be dispensed from a dispenser 10 made in accord with the invention and manufactured in an appropriate size and strength.

The dispenser 10 has a rectangular, generally box-like storage bin 12. The storage bin 12 has opposed rear and front walls 14, 16 and opposed side walls 18. For convenience, the dispenser 10 and parts thereof sometimes will be described below as having front or frontwardly oriented parts corresponding in orientation to the front and rear walls 16, 14, and ends or endwardly extending parts corresponding in orientation to the side walls 18.

Interiorly presented surfaces of the rear, front, and side walls 14, 16, 18 define a chamber 15 having a size sufficient to contain the elongated articles to be dispensed, such as the conventional drinking straws shown at 17, with the longitudinal axis of the elongated articles extending generally horizontally between the side walls 18. All of the walls 14, 16, 18 extend generally vertically, and their uppermost margins join to define a top opening 20. A lid 22 is provided to close the top opening 20. The lid 22 is openable and, when opened, leaves the top opening 20 substantially unobstructed. The top opening 20 preferably is of a size substantially as large as the interior size of the chamber 15.

The front wall 16 has an article discharge slot extending substantially the horizontal length of the front wall 16. The article discharge slot 24 extends entirely through the front wall 16, into the chamber 15, and is sufficiently large to allow passage therethrough of an elongated article to be dispensed, with the longitudinal axis of the elongated article generally horizontal and extending roughly parallel to the front wall 16.

It is possible to make a dispenser 10 constructed in accord with the present invention having an article discharge slot 24 only in the front wall 16. However, it is preferred for many applications that the rear wall 14 also have an entirely comparable article discharge slot 24. In that event, the dispenser 10 has corresponding frontward and rearward parts and preferably is bilaterally symmetrical from front to rear, as is shown in the Figures. Consequently, no further distinction shall be made in the disclosure below between such corresponding frontward and rearward parts, with only the frontward parts being expressly described. Corresponding frontward and rearward parts shall be given the same reference numbers.

The chamber 15 has a floor 26. The chamber floor 26 inclines downwardly from a selected point between the front and rear walls 16, 14 toward the article discharge slot 24, terminating in a discharge margin 28. The discharge margin 28 extends generally parallel to the front wall 16 and is spaced therefrom sufficiently to allow simultaneous passage therebetween of a selected number and preferably only one elongated article. Thus, in the embodiment shown in the figures, the discharge margin 28 is separated from the front wall 16 by a distance sufficient to allow only one drinking straw 17 at a time to pass therethrough.

Figure 5:
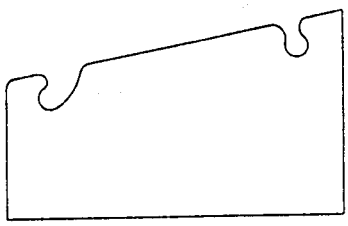
FIG. 5 is a side elevation view of a side bracket.

The dispenser 10 includes end braces 30. One such end brace 30 is aligned with and preferably attached to interior surfaces of each of the side walls 18 at a location beneath the chamber floor 26. A side elevation view of the preferred embodiment of an end brace 30 is shown in FIG. 5. For manufacturing convenience, the end braces 30 are generally flat and so symetrically manufactured from side to side that the same end brace may be used against either of the side walls 18.

The end braces 30 have a front edge 32, a rear edge 34, and a top edge 36. When both the front and rear walls 16, 14 of the storage bin 12 have article discharge slots 24, as is described above, and shown in the Figures, two end braces 30 are associated with each of the bin side walls 18, one frontward and one rearward, with their rear edges 34 abutting. Alternatively and preferably, in such an event, the two abutting end braces 30 are manufactured as a unitary object bilaterally symmetrical about a lateral, vertical axis extending parallel to the front edges 32.

The end braces 30 are attached rigidly to the side walls 18 by gluing, riveting, unitary molding, or such other means as may prove convenient. In general terms, the end braces 30 serve to support the chamber floor 26 in a manner that will be described in greater detail below. The top edge 36 of the end braces 30 slants downwardly from rear to front at the same angle as that of the chamber floor 26 and at a location just below that of the chamber floor. The top edge 36 of an end brace 30 has a front engagement notch 38 and rear engagement notch 40, both notches preferably extending entirely through the end brace from side to side. The front engagement notch 38 includes rearwardly presented, undercut retention surfaces 42. Otherwise, the front engagement notch 38 is generally upperwardly and rearwardly open without frontwardly presented undercut surfaces. Consequently, an object may be slid into the front engagement notch 38 from a rearward direction to be engaged therein by retention beneath the retention surfaces 42 for so long as rearward movement of the object is prevented. The rear engagement notch 40 opens generally upwardly and has a narrowed neck 44.

Figure 4:
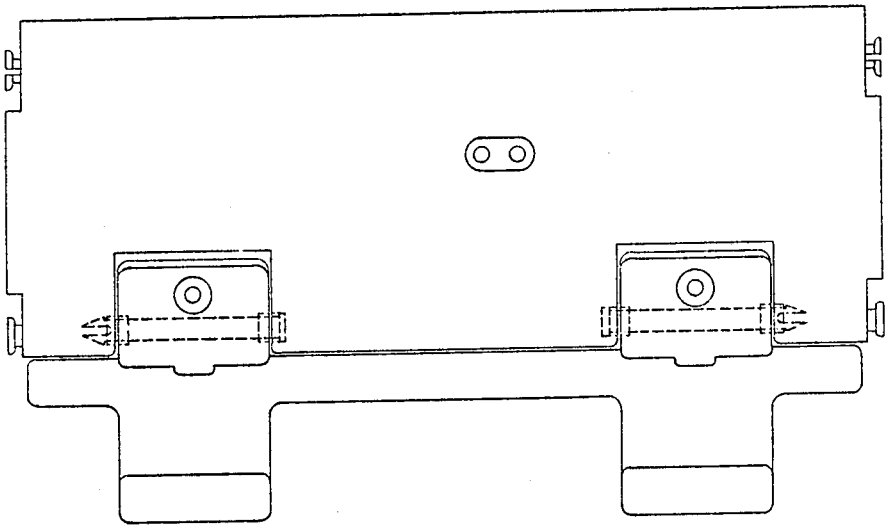
FIG. 4 is a top plan view of a dispensing member pivotally mounted upon a bottom plate.

The chamber floor 26 is generally rectangular in shape with opposed floor side edges 46 and a floor front edge 48. The floor side edges 46 extend parallel and adjacent to substantially the full length of the top edge 36 of the associated end brace 30. A floor pin support 50 extends downwardly from each of the floor side edges 46 for a selected distance, as is shown in phantom in FIG. 4. The floor pin supports 50 are so spaced from each other that they may freely enter the space between the opposed end braces 30. A front floor pin 52 and a rear floor pin 54 extend generally horizontally outwardly from each of the floor pin supports 50. Preferably the front floor pin 52 is solid, while the rear floor pin 54 is split so as to be laterally compressible. The front and rear floor pins 52, 54 are separated from each other by a distance such that, when the front floor pin is inserted into the front engagement notch 38, the rear floor pin 54 may be thrust down into the rear engagement notch 40, compressing slightly to pass the narrowed neck 44 thereof and then resiliently resuming its original size to allow the rear floor pin to be retained in the rear engagement slot by by the narrowed neck. Alternatively, the narrowed neck 44 may be elastically deformable to allow a rigid rear floor pin 54 to pass therethrough. Thus the rear floor pin 54 so engaged prevents rearward movement of the front floor pin 52. As a consequence, the front floor pin 52 is held in the front engagement notch 38 beneath the retention surfaces 42 thereof.

The floor front edge 48 has at least one and preferably two floor slots 56. Each floor slot 56 extends entirely through the floor 26 and opens forwardly. A pivot pin support 58 extends downwardly at each side of each floor slot 56, as is shown in phantom in FIG. 4. A pivot pin 60 extends parallel to the floor front edge 48 between the pivot pin supports 58 of each floor slot 56, as is shown in phantom in FIG. 4. Most conveniently, the pivot pin supports 58 have holes (not shown) adapted to receive a pivot pin 60. Pivot pin 60 having a conventional head 59 and compressible split tip 61, as is shown in phantom in FIG. 4, may be conveniently snapped into and back out of place through such holes in the pivot pin supports 58, making manufacture and repair simple and convenient. A support member 62 extends downwardly from the rearwardmost margin of each floor slot 56. At a selected distance beneath the floor 26, a stop member 64 extends forwardly from the support member 62.

The dispenser 10 of the invention further includes a pivoting lever arm 66. The lever arm 66 includes hinge members 67 adapted to extend into and substantially fill each floor slot 56. At least one and preferably all of the hinge members 67 include a generally horizontally extending pivot hole 68 adapted to be engaged over a pivot pin 60 in freely turning relation. Thus, the entire lever arm 66 is adapted to be hingedly attached to the floor 26, turning about an axis generally parallel to the floor front edge 48 and, in turn, the article discharge slot 24. The lever arm 66 extends from side to side at least across the full width of all of the floor slots 56 and preferably for the full width of the floor 26.

The lever arm 66 includes at least one handle 70 adapted to extend forwardly and protrude through the article discharge slot 24. The handle 70 terminates in a press tab 72 adapted to receive downward pressure from the fingertips of a user of the dispenser 10. The press tab 72 is located at a selected height relative to the remaining parts of the handle 70. The handle 70 further includes an upwardly presenting recessed dispensing surface 74 extending from the press tab 72 rearwardly through the article discharge slot 24 a selected distance. The recessed dispensing surface 74 is recessed beneath the level of the press tab 72.

Figure 3:
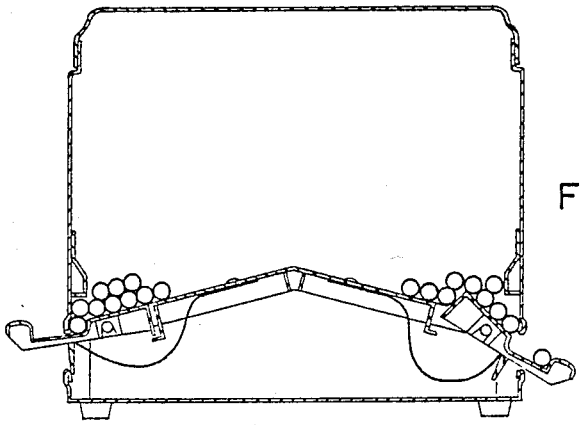
FIG. 3 is a cross sectional view taken along section line 3—3 of FIG. 1.

The lever arm 66 further includes an upwardly presenting staging surface 76. The staging surface 76 is located adjacent to the rearwardmost extension of the recessed dispensing surface 74 and extends rearwardly therefrom to the rearwardmost extension of the lever arm 66. The staging surface 76 is elevated with respect to the recessed dispensing surface 74, the rearwardmost margin of which curves upwardly to meet the staging surface. A contact member 78 extends downwardly from the rearwardmost extension of the staging surface 76. The contact member 78 has a length such that it contacts and is stopped by the stop member 64 when the lever arm 66 has so pivoted that the rearwardmost portion of the staging surface 76 is approximately flush with the chamber floor 26. In the preferred embodiment shown in FIG. 3, the staging surface 76 and floor 26 are co-planar when the lever arm 66 is in that position. That position, wherein the forwardmost parts of the lever arm 66 are elevated, shall be referred to herein as the "closed" position of the lever arm. The lever arm 66 may be pivoted so as to lower the press tab 72 until the lever arm has reached a selected position that shall be referred to herein as the "dispensing" position, wherein the fowardmost parts of the lever arm are depressed.

With the lever arm 66 in the closed position, the staging surface 76 extends forwardly to terminate at an edge 80 of greatest forward extension so located point such that the edge 80 is approximately aligned with the discharge margin 28 of the chamber floor 26. The article discharge slot 24 is so located that the recessed dispensing surface 74 of the lever arm 66 is close enough thereto when the lever arm is in its closed position to prevent the escape of any elongated article resting on the recessed dispensing surface. Consequently, when the lever arm 66 is in its closed position, a holding space 82 is defined between the edge 80 of greatest forward extension of the staging surface 76, that portion of the recessed dispensing surface 74 rearward from the front wall 16, and an adjacent portion of the front wall. It will be apparently that the holding space has a size sufficient to hold a single one of the elongated articles to be dispensed.

When the lever arm 66 is moved to its dispensing position, the recessed dispensing surface 74 is lowered sufficiently to allow the elongated article held in the holding space 82 to pass out of the article discharge slot 24. The recessed dispensing surface 74 extends at an angle relative to the staging surface 76 such that it slants downwardly and forwardly when the lever arm 66 is in its dispensing position. Consequently, an elongated article held in the holding space 82 is urged by gravity to roll forwardly until stopped by the press tab 72. Meanwhile, the edge 80 of greatest forward extension of the staging surface 76 has moved slightly toward the front wall 16 as a consequence of its rotation about the pivot pin 60. As a result, no additional elongated articles can pass therebetween, and only that article previously held in the holding space 82 is dispensed. When the lever arm 66 is returned to its closed position, the holding space 82 is defined once again, and a subsequent elongated article can roll forwardly down the staging surface 76 and drop downwardly to enter it.

Preferably a sorting deflector 84 is attached to the forward wall by riveting, gluing, unitary molding, or any other convenient method. The sorting deflector 84 extends inwardly into the chamber 15 and preferably extends generally between the side walls 18. The sorting deflector 84 extends inwardly for at least approximately the diameter of one of the elongated articles to be dispensed from the dispenser 10, and it is located above the staging surface 76 when the lever arm 66 is in a closed position at a distance therefrom of at least one diameter and less than two diameters of an article to be dispensed. As a consequence, the articles to be dispensed are constrained to approach the holding space 82 one at a time, generally in single file. This helps to avoid any jamming that would otherwise prevent the elongated articles from smoothly feeding into the holding space 82.

The coacting structures and parts described above, with or without a sorting deflector 84, are an example of retaining means for retaining the elongated articles within the chamber 15 when the lever arm 66 is in its closed position and dispensing a selected number of elongated articles through the article discharge slot when the lever arm is in its dispensing position. Clearly other such means are possible and are included within the scope and spirit of the invention.

It is desirable that the lever arm 66 be biased, preferably toward its closed position. Alternative means are provided to achieve this biasing. The lever arm 66 includes a spring stop 86. The spring stop 86 extends downwardly from the handle 70 at a location forward of the pivot hole 68. Preferably the spring stop 86 is so located and has such a length as to generally close that part of the discharge slot 24 that remains open beneath the level of the handle 70 when the lever arm 66 is in its closed position. A longitudinally extended leaf spring 88 may then be attached by one end to the under side of the chamber floor 26. The other end of the leaf spring 88 may extend forwardly to be wedged against the rearward side of the spring stop 86. The length of the leaf spring 88 is selected to exceed the distance from its point of attachment to the chamber floor 26 to the spring stop 86, so that the leaf spring must be bowed downwardly to remain in the position disclosed above. The leaf spring 88 is selected to be substantially straight when in its rest posture, so that the bowed leaf spring tends to force the lever arm 66 toward its closed position.

Alternatively or additionally, a counter weight well 90 may be located in at least one of the hinged members 67 of the lever arm 66. The counter weight well 90 is located rearwardly of the pivot hole 68 and is adapted to contain a counter weight 92 at a level such that no part of the counter weight rises above the staging surface 76. Means are provided for retaining the counter weight 92 in the counter weight well 90. It is convenient that the counter weight well 90 be cylindrical with a central pedestal 94 extending upwardly within the counter weight well along its longitudinal axis. The counter weight 92 may then be in the form of a selected number of washers or of a cylindrical mass with a central opening extending parallel to its longitudinal axis. The central pedestal 94 may be split and slightly expanded at its upward end so that the washers being employed as the counter weight 92 may be retained in the counter weight well 90 by outward pressure exerted by the split end of the central pedestal against the sides of the central hole of the washers or cylindrical mass. Alternatively, the end of the central pedestal 94 may be deformed after the washers or cylindrical mass have been placed thereover.

Biasing of the lever arm 66 allows dispensing of a sequence of elongated articles by repeated presses on the press tab 72, interrupted only by the time required to allow the lever arm to return to its closed position between presses under force of the bias. Moreover, provision of significant bias force will cause a lever arm, once released from its dispensing position, to quickly snap back to its closed position, thereby jostling many of the elongated articles supported either directly or indirectly by the lever arm 66. Such forceful disruption helps to dislodge any bridging of elongated articles that would otherwise prevent a continuous feed of articles toward the holding space 82.

The rigid parts of the dispenser 10 may all be manufactured from any appropriate, rigid material. However, the parts are designed to be especially convenient for manufacture from plastic by molding. A special advantage of the structure disclosed above is the ease with which it may be assembled or disassembled for repair. The manufacturing difficulties associated with such dispensers often is related to the necessity to assemble moving parts in place, within the constraints of a chamber such as the chamber 15 of the invention.

That problem is entirely avoided in the dispenser 10 for elongated articles disclosed above with respect to the moving parts included in the lever arm-floor assembly, which moving parts include substantially all of the moving parts of the dispenser 10 whose function directly relates to dispensing elongated articles. After the storage bin 12 has been manufactured from metal, plastic, or the like, the end braces 30 may be installed through the top opening 20, if they have not already been unitarily molded as part of the side walls 18. Likewise, the sorting deflector 84 may be inserted through the top opening 20 and fastened to the front wall 16. It will be apparent that at this stage of assembly, the chamber 15 remains essentially empty, allowing easy access to its interior for the steps of assembly just described.

Next, the pivoting lever arm 66 may be held in place with respect to the chamber floor 26, and pivot pins 60 may be thrust into position. If used, counter weights 92 may next be installed in the counter weight well 90. If a leaf spring 88 is used, it may then be fastened to the chamber floor 26 and flexed into position behind the spring stop 86. All of this assembly procedure may be accomplished outside of the storage bin 12, so that the person assembling the parts has an entirely unobstructed view of and access to all of the parts. Taken together as a completed assemblage, the lever arm 66, floor 26, and means for biasing the lever arm, whether such means include a leaf spring 88, counter weight 92, or some combination of the two, shall be referred to as a "lever arm-floor assemblage."

It will be apparent that it is an easy matter to slip the lever arm-floor assemblage through the top opening 20 and into the chamber 15. The handle 70 of the lever arm 66 may be guided through the discharge slot 24 as the front floor pin 52 is slipped into the front engagement notch 38. With the front floor pin 52 in place, the rear floor pin 54 may then be thrust directly downwardly into the rear engagement notch 40 to complete the installation of the lever arm-floor assemblage in secure but removable attachment to the bin 12. When the dispenser 10 is provided with an article discharge slot 24 in both the front and rear walls 16, 14, as is shown in the Figures, a front lever arm-floor assemblage may be installed in the manner described, to occupy the front half of the chamber 15. Then a rear lever arm-floor assemblage corresponding in all respects to the front lever arm-floor assemblage may be installed in the rearward half of the dispenser 10.

In the event a leaf spring 88 breaks or some other part of the lever arm-floor assemblage needs to be replaced, it is a simple matter to draw the lever arm-floor assemblage upwardly at its rearward most part and remove it from the dispenser 10, simply reversing the steps by which it was inserted. By use of the structure described, parts that otherwise would be impossible or difficult to reach can be made completely accessible and conveniently replaceable. Thus a dispenser 10 that might otherwise been impossible or very difficult to repair is readily repaired with movable parts that may be renewed simply and with ease. This important feature of the dispenser 10 of the invention makes it economically realistic to construct the storage bin 12 out of stainless steel or other durable and relatively expensive materials. It may be anticipatible that the lever arm 66, spring 88, or some other movable part is likely to fail before the storage bin 12 needs to be replaced. By means of the features of the invention disclosed above, such failed parts may be economically repaired or replaced repeatedly.

Figure 6:
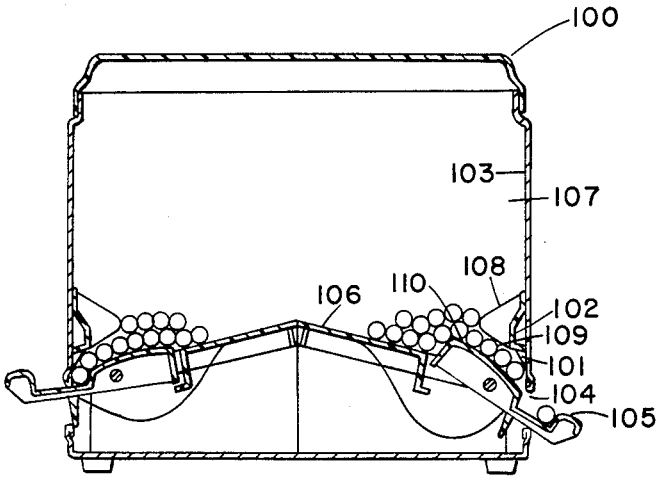
FIG. 6 is a cross sectional view analogous to that of FIG. 3 for a second embodiment of this invention.

As mentioned above, a smooth feed of elongated articles is aided by the sorting deflector 84 which allows only one article to approach the holding space 82. FIG. 6 shows at 100 a second embodiment of this invention in which a smooth feed is further aided by provision of at least one and preferably a plurality of fins 101 which taper downward from near the bottom of the sorting deflector 102 to meet the front wall 103 above the discharge slot 104, thereby substantially eliminating any opening below the sorting deflector in which an elongated article can become pinched against the front wall. Thus, elongated articles, even when under substantial pressure from articles loaded above, are constrained between the fins 101 and the lever arm-floor assembly (comprising lever arm 105 hingedly attached to chamber floor 106) and toward the discharge slot 104.

The second embodiment shown in FIG. 6 provides for the continued dispensing of elongated articles during several lever arm cycles even when bridging of elongated articles occurs in the dispenser chamber 107. In particular, at least one and preferably three baffles 108 extend from the bottom of the sorting deflector 102 at least one and preferably three to four article diameters beyond the sorting deflector into the chamber 107. The bottoms of the baffles 108 are shaped and positioned above the lever arm-floor assembly to form a channel 109 which accommodates a plurality of elongated articles aligned in generally single file toward the discharge slot 104. Thus, a bank of unjammable elongated articles is provided when no bridging occurs, and when bridging does occur, dispensing will not be interrupted for at least several lever arm cycles. Where the lever arm 105 is biased and allowed to snap back from its dispensing position to its closed position during each cycle, the bank of aligned articles produced by the baffles 108 affords a substantial opportunity to dislodge any bridge of articles without interrupting dispensing.

Figure 7:
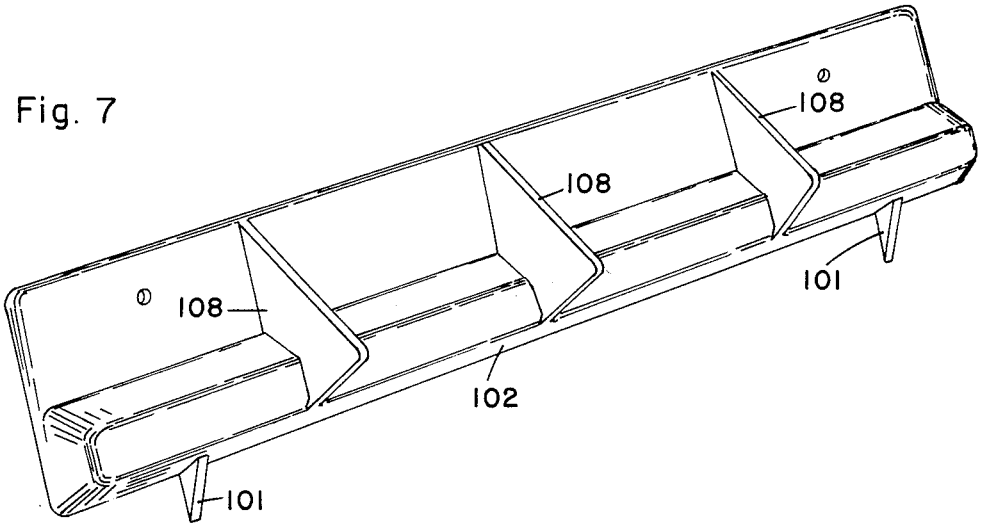
FIG. 7 is an isolated perspective view of a sorting reflector of the second embodiment with fins and baffles attached thereto by unitary molding.

As best shown in FIG. 7, the baffles 108 as well as the fins 101 of the second embodiment are preferably attached to the sorting deflector 102 by unitary molding. This provides additional convenience by allowing simultaneous attachment of the sorting deflector 102, the fins 101, and the baffles 108 to the front wall 103.

The lever arm 105 of the embodiment shown in FIG. 6 has a staging surface 110 which is slightly raised with respect to the floor 106 when in the closed position. Rearward extension of the staging surface 110 substantially beyond the rearward extent of the baffles 108 allows jostling of the elongated articles during the dispensing cycle. Moreover, the baffles 108 may be situated so that they are not directly above the raised staging surface 110. This positioning allows for bending of resilient elongated articles jammed into the channel 109, thereby creating a resilient force to dislodge the jam.

The methods of assemblage disclosed above are those preferred for assembling a dispenser 10 made in accord with the invention. Likewise, the particular parts and relations described are those preferred. However, it will be apparent that other materials, parts, and modes of assembly are possible. It is understood that the present invention is not limited to the particular materials, construction, and arrangement of parts illustrated and disclosed above. Instead, it embraces all such modified forms thereof as come within the scope of the following claims.

What is claimed is:

1. A dispenser for elongated articles that is especially adapted for convenient assembly comprising;

(a) a storage bin having a front wall and a rear wall opposed thereto and opposed side walls, inner surfaces of which walls define a chamber, the front wall having an article discharge slot extending substantially from side wall to side wall that has a size sufficient to allow an elongated article to be dispensed therethrough with its longitudinal axis oriented generally horizontally and parallel to the front wall;

(b) a chamber floor contained within the chamber and inclining downwardly toward the article discharge slot;

(c) a lever arm hingedly attached to the chamber floor to form therewith a lever arm-floor assemblage having a lever arm portion and a floor portion, the lever arm-floor assemblage including substantially all of those moving parts of the dispenser whose function directly relates to dispensing elongated articles therefrom, the lever arm extending forwardly through the article discharge slot and having a dispensing position, in which its forwardmost parts are depressed, and a closed position, in which its forwardmost parts are elevated;

(d) retaining means for retaining the elongated articles within the chamber when the lever arm is in its closed position and dispensing a selected number of elongated articles through the article discharge slot when the lever arm is in its dispensing position;

(e) a pair of end braces located in the chamber, each generally adjacent one of the sidewalls, the floor portion of said lever arm-floor assemblage being releasably attachable to the end braces so that the lever arm-floor assemblage, after preassembly outside the chamber, can be releasably secured to the end braces, so that said assemblage is mounted within the chamber;

(f) wherein the end braces further have a front engagement notch and a rear engagement notch, the front engagement notch including rearwardly presented, undercut retention surfaces and being otherwise generally upwardly and rearwardly open, the rear engagement notch opening generally upwardly and having a narrowed neck; and (g) wherein the chamber floor has opposed floor side edges extending generally adjacent to the side walls, the chamber floor further having a front floor pin and a rear floor pin that extend endwardly at each floor side edge, the front and rear floor pins being separated from each other by a distance such that, when the front floor pin is inserted into the front engagement notch, the rear floor pin may be thrust down into the rear engagement notch, passing the narrowed neck thereof to be retained therein, so that the chamber floor and other parts of the lever arm-floor assemblage may be attached within the chamber in secure, rigidly attached relation.

2. The dispenser of claim 1 wherein the rear floor pin is elastically compressible.

3. The dispenser of claim 1 wherein the narrowed neck of the rear engagement notch is elastically deformable.

4. A dispenser for elongated articles that is especially adapted for convenient assembly comprising:

(a) a storage bin having a front wall and a rear wall opposed thereto and opposed side walls, inner surfaces of which walls define a chamber, the front wall having an article discharge slot extending substantially from side wall to side wall that has a size sufficient to allow an elongated article to be dispensed therethrough with its longitudinal axis oriented generally horizontally and parallel to the front wall;

(b) a chamber floor contained within the chamber and inclining downwardly toward the article discharge slot;

(c) a lever arm hingedly attached to the chamber floor to form therewith a lever arm-floor assemblage having a lever arm portion and a floor portion, the lever arm-floor assemblage including substantially all of those moving parts of the dispenser whose function directly relates to dispensing elongatged articles therefrom, the lever arm extending forwardly through the article discharge slot and having a dispensing position, in which its forwardmost parts are depressed, and a closed position, in which its forwardmost parts are elevated;

(d) retaining means for retaining the elongated articles within the chamber when the lever arm is in its closed position and dispensing a selected number of elongated articles through the article discharge slot when the lever arm is in its dispensing position;

(e) a pair of end braces located in the chamber, each generally adjacent one of the sidewalls, the floor portion of said lever arm-floor assemblage being releasably attachable to the end braces so that the lever arm-floor assemblage, after preassembly outside the chamber, can be releasably secured to the end braces, so that said assemblage is mounted within the chamber;

(f) wherein the floor extends forwardly to terminate in a floor front edge, the floor front edge having a floor slot that extends generally vertically through the floor and opens forwardly, and the floor including a pivot pin support extending downwardly at each side of the floor slot;

(g) wherein the lever arm includes a rearwardly extending hinge member that substantially fills the floor slot, the hinge member including a generally horizontally extending pivot hole; and (h) a pivot pin adapted to extend through the pivot hole in freely turning relation and to be fastenable to the pivot pin supports, whereby the lever arm may be hingedly attached to the chamber floor.

5. The dispenser of claim 4 in which the lever arm is biased toward its closed position.

6. The dispenser of claim 5 wherein the lever arm includes a counter weight securely attached to the lever arm rearwardly of the pivot hole to bias the lever arm toward its closed position.

7. A dispenser for elongated articles that is especially adapted for convenient assembly comprising:

(a) a storage bin having a front wall and a rear wall opposed thereto and opposed side walls, inner surfaces of which walls define a chamber, the front wall having an article discharge slot extending substantially from side wall to side wall that has a size sufficient to allow an elongated article to be dispensed therethrough with its longitudinal axis oriented generally horizontally and parallel to the front wall;

(b) a chamber floor contained within the chamber and inclining downwardly toward the article discharge slot, the chamber floor having opposed floor side edges extending generally adjacent to the side walls of the storage bin, the chamber floor further having a front floor pin and a rear floor pin that extend endwardly at each floor side edge, the floor further having a floor front edge that has a floor slot that extends generally vertically through the floor and opens forwardly with a pivot pin support extending downwardly beside the floor slot;

(c) a lever arm hingedly attached to the chamber floor to form therewith a lever arm-floor assemblage having a lever arm portion and a floor portion, the lever arm-floor assemblage including substantially all of those moving parts of the dispenser whose function directly relates to dispensing elongated articles therefrom, the lever arm extending forwardly through the article discharge slot and having a dispensing position, in which its forwardmost parts are depressed, and a closed position, in which its forwardmost parts are elevated, the lever arm including a rearwardly extending hinge member not larger than the floor slot, the hinge member including a generally horizontally extending pivot hole, the dispenser further including a pivot pin adapted to extend through the pivot hole in freely turning relation and to be fastenable to the pivot pin support to hingedly attach the lever arm to the chamber floor;

(d) retaining means for retaining the elongated articles within the chamber when the lever arm is in its closed position and dispensing a selected number of elongated articles through the article discharge slot when the lever arm is in its dispensing position;

(e) a pair of end braces, one generally adjacent to each of the side walls, each end brace having a top edge having a front engagement notch and a rear engagement notch, the front engagement notch including rearwardly presented, undercut retention surfaces and being otherwise generally upwardly and rearwardly open, the rearward engagement notch opening generally upwardly and having a narrowed neck, the front and rear engagement notches being separated from each other by a distance such that when the front floor pin is inserted into the front engagement notch, the rear floor pin may be thrust down into the rear engagement notch, passing the narrowed neck thereof to be retained therein, whereby the chamber floor and other parts of the lever arm-floor assemblage may be attached within the chamber in secure, rigidly attached relation.

8. The dispenser of claim 7 wherein the rear floor pin is elastically compressible.

9. The dispenser of claim 7 wherein the narrowed neck of the rear engagement notch is elastically deformable.

10. The dispenser of claim 7 in which the lever arm is biased toward its closed position.

11. The dispenser of claim 10 wherein the lever arm includes a counter weight securely attached to the lever arm rearwardly of the pivot hole to bias the lever arm toward its closed position.

12. The dispenser of claim 7 further comprising a sorting deflector which extends at least one article diameter into the chamber from the front wall, which sorting deflector is positioned at least one but less than two article diameters above the lever arm-floor assemblage such that the articles to be dispensed are constrained to approach the discharge slot in substantially single file.

13. The dispenser of claim 12 further comprising at least one fin which tapers downward from near the bottom of the sorting deflector to meet the front wall above the discharge slot such that there is no opening between the bottom of the sorting deflector and the front wall in which an elongated article can be pinched.

14. The dispenser of claim 12 further comprising at least one baffle which extends from the bottom of the sorting deflector at least one article diameter further into the chamber above the lever arm-floor assemblage; and wherein the bottom of each baffle and the lever arm-floor assemblage are shaped to form a channel which accommodates a plurality of elongated articles aligned in generally single file toward the discharge slot.

15. The dispenser of claim 14 wherein the lever arm extends rearwardly substantially beyond the rearward extent of the baffles, and is pivotally mounted to the floor such that when the lever arm is moved to its dispensing position, the rearward portion of the lever arm rises above the floor and jostles elongated articles within the chamber.

* * * * *